US007044579B2

(12) United States Patent
Katsuumi

(10) Patent No.: US 7,044,579 B2
(45) Date of Patent: May 16, 2006

(54) MAINTENANCE METHOD AND MAINTENANCE APPARATUS FOR INK JET HEAD

(75) Inventor: Kazushige Katsuumi, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/600,434

(22) Filed: Jun. 23, 2003

(65) Prior Publication Data

US 2004/0017422 A1 Jan. 29, 2004

(30) Foreign Application Priority Data

Jun. 24, 2002 (JP) ..... 2002-182831

(51) Int. Cl.
*B41J 2/165* (2006.01)

(52) U.S. Cl. ..... 347/30; 347/29

(58) Field of Classification Search ..... 347/29, 347/30, 35, 20

See application file for complete search history.

(56) References Cited

U.S. PATENT DOCUMENTS 4,947,191 A 8/1990 Nozawa et al.
5,128,690 A * 7/1992 Nozawa ..... 347/30
6,000,792 A 12/1999 Koizumi et al.
6,390,594 B1 * 5/2002 Tanno et al. ..... 347/32
6,619,783 B1 * 9/2003 Kanaya et al. ..... 347/35
6,786,566 B1 * 9/2004 Shindo ..... 347/30

FOREIGN PATENT DOCUMENTS

JP 04070350 A * 3/1992
JP 5-517 1/1993
JP 5-201028 8/1993

* cited by examiner

*Primary Examiner*—Stephen Meier
*Assistant Examiner*—Ly T. Tran
(74) *Attorney, Agent, or Firm*—Oblon, Spivak, McClelland, Maier & Neustadt, P.C.

(57) ABSTRACT

A maintenance apparatus is used for maintaining an ink jet head which ejects ink supplied via an ink supply path, as ink droplets from a plurality of orifices arranged in an orifice plate. The apparatus comprises a pressure control section which controls the pressure in the ink supply path against the atmospheric pressure applied to a surface of the ink to push ink out of each orifice and then align the surface of the ink to a surface of the orifice plate, and an ink suction section which sucks ink near each orifice in a state where the ink surface is approximately aligned to the surface of the orifice plate by the pressure control section.

14 Claims, 2 Drawing Sheets

MAINTENANCE METHOD AND MAINTENANCE APPARATUS FOR INK JET HEAD

CROSS-REFERENCE TO RELATED APPLICATIONS

This application is based upon and claims the benefit of priority from the prior Japanese Patent Application No. 2002-182831 filed Jun. 24, 2002, the entire contents of which are incorporated herein by reference.

BACKGROUND OF THE INVENTION

1. Field of the Invention

The present invention relates to a maintenance method and a maintenance apparatus for an ink jet head that ejects ink droplets onto recording paper for printing characters and graphics.

2. Description of the Related Art

Generally, an ink jet printer is equipped with an ink jet head where a plurality of ink jet nozzles are arranged. The ink jet head easily gets to a state where it is difficult to eject ink because the nozzle is clogged or a pressure loss occurs due to paper dust or an air bubble entering through an orifice arranged at the tip of each ink jet nozzle. Therefore, maintenance of the ink jet head is required for recovery from the state to overcome this problem.

For example, Jpn. Pat. Appln. KOKAI Publication No. 5-517 discloses an ink jet printer that performs such maintenance. This ink jet printer attaches a cap closely to head nozzles and operates an ink suction pump with an atmosphere valve closed to generate a negative pressure in the cap and suck an air bubble or dirt in the nozzles. In the middle of this suction process, the ink jet printer further opens the atmosphere valve and once returns the air bubble remaining in the nozzle to the ink. The ink jet printer again closes the atmosphere valve and sucks the ink to completely eject the air bubble.

If the atmosphere valve is opened in the middle of the suction process to once return the air bubble remaining in the nozzle to the ink as mentioned above, however, a dirt particle such as paper dust attached to the nozzle also enters the nozzle. There has been a problem in that the dirt particle, depending on its size or shape, cannot be ejected even if the atmosphere valve is closed again to suck the ink.

BRIEF SUMMARY OF THE INVENTION

It is an object of the present invention to provide a maintenance method for the ink jet head and a maintenance apparatus capable of reliably removing particles such as paper dust, dirt, and air bubbles attached near the orifice.

The present invention provides a maintenance method for an ink jet head which ejects ink supplied via an ink supply path, as ink droplets from a plurality of orifices arranged in an orifice plate, the method comprising: controlling the pressure in the ink supply path against the atmospheric pressure applied to a surface of the ink to push the ink out of each orifice and then align the surface of the ink to a surface of the orifice plate; and sucking ink near each orifice in a state where the ink surface is approximately aligned to the surface of the orifice plate.

Further, the present invention provides a maintenance apparatus for an ink jet head which ejects ink supplied via an ink supply path, as ink droplets from a plurality of orifices arranged in an orifice plate, the apparatus comprising: a pressure control section which controls the pressure in the ink supply path against the atmospheric pressure applied to a surface of the ink to push ink out of each orifice and then align the surface of the ink to a surface of the orifice plate; and an ink suction section which sucks ink near each orifice in a state where the ink surface is approximately aligned to the surface of the orifice plate by the pressure control section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

An ink jet printer according to an embodiment of the present invention will be described below, with reference to the accompanying drawings.

Figure 1:
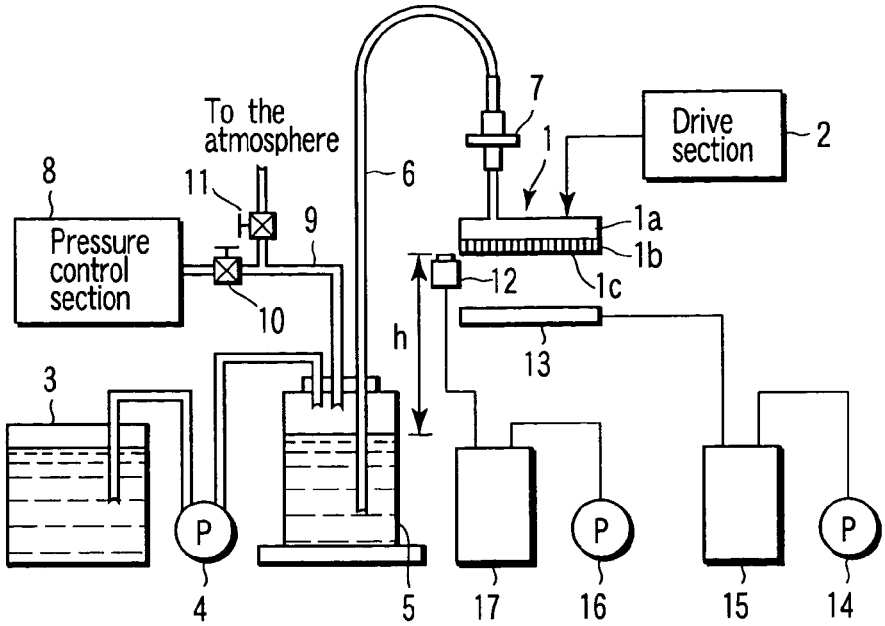
FIG. 1 shows a configuration of an ink jet printer according to an embodiment of the present invention.

FIG. 1 shows a configuration of the ink jet printer. The ink jet printer comprises an ink jet head 1 which ejects ink droplets onto recording paper to print characters and graphics, a drive section 2 which drives the ink jet head 1 at the time of printing, and an ink supply tank 3 which stores ink to be supplied to the ink jet head 1.

An ink supply pump 4 supplies ink from the ink supply tank 3 into an ink control tank 5. The ink in the ink control tank 5 is supplied to the ink jet head 1 via an ink supply path 6. The ink supply path 6 is provided with a filter 7 which prevents dirt mixed into ink from entering the ink jet head 1.

The ink control tank 5 is sealed to locate an air layer above an ink layer. A first air pressure supply path 9 is inserted into the air layer. The air pressure supply path 9 branches into two paths above the ink control tank 5. One path is provided with a first supply path solenoid valve 10 to lead the air layer in the ink control tank 5 to a pressure control section 8. The other path is provided with a second supply path solenoid valve 12 to lead the air layer in the ink control tank 5 to the atmosphere.

The ink jet head 1 comprises a common ink chamber 1*a*, a plurality of ink jet nozzles 1*b* connected to the ink chamber 1*a*, and an orifice plate 1*c* having a plurality of orifices 21 which are arranged in a row with a specified interval and serve as the tips of the ink jet nozzles 1*b*. The orifice plate 1*c* further has an orifice guard 24 which is a protection member arranged to surround each orifice 21 in a front plane of the ink jet head 1. That is, the surface of the orifice plate 1*c* is substantially formed of the orifice guard 24. The orifice guard 24 is obtainable by bonding a metallic plate formed, for example, of stainless steel and coated with an ink-repellant film to the orifice plate 1*c*, or by coating the orifice plate 1*c* with an ink-repellant film. A suction nozzle 12 is provided adjacent to the orifice plate 1*c*. The suction nozzle 12 is positioned at one side of the orifice plate 1*c* at the time of printing and is movable in the arrangement direction of the orifices 21 along the surface of the orifice plate 1*c* at the time of maintenance. The suction nozzle 12 faces each of the orifices 21 while moving, and collects ink unnecessarily remaining near the orifice (specifically inside and around the orifice) together with dirt and air bubbles.

The pressure control section 8 is used to control an air pressure of the air layer in the ink control tank 5. When the air pressure of the air layer is increased for a purge operation of ink, this pressure is applied to the common ink chamber 1*a* of the ink jet head 1 via the ink supply path 6, discharging ink as waste ink from each orifice 21. A waste ink tray 13 collects waste ink discharged from the orifice 21 in the purge operation. A pump 14 draws the waste ink accumulated in the waste ink tray 13 into a first waste ink bottle 15. The suction nozzle 12 is associated with a pump 16 to form an ink suction section which sucks unnecessary ink near the orifice 21. After the purge operation, the pump 16 draws the unnecessary ink into a second waste ink bottle 17 via the suction nozzle 12.

Figure 6:
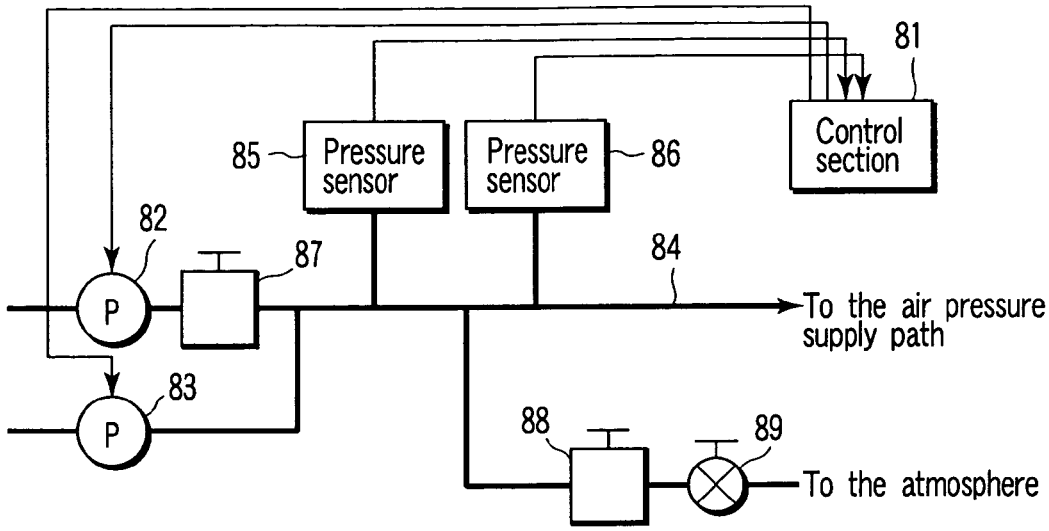
FIG. 6 shows a configuration of a pressure control section in FIG. 1.

As shown in FIG. 6, for example, the pressure control section 8 includes a control section 81, a first pressure control pump 82, a second pressure control pump 83, a second air pressure supply path 84, a first pressure sensor 85, a second pressure sensor 86, a first solenoid valve 87, a second solenoid valve 88, and a needle valve 89. The pressure control pump 82 comprises a diaphragm pump or the like connected to the air pressure supply path 84 via the solenoid valve 87. The pressure control pump 83 comprises a tube pump or the like connected to the air pressure supply path 84. The air pressure supply path 84 is connected to the first air pressure supply path 9 and to the atmosphere via the solenoid valve 88 and the needle valve 89. The pressure sensors 85 and 86 detect pressure states of the air pressure supply path 84. The control section 1 confirms pressure states of the air pressure supply path 84 detected by the pressure sensors 85 and 86 to control the pressure control pumps 82 and 83. The needle valve 89 is arranged nearer to the atmosphere than the solenoid valve 88 to adjust a flow rate of air.

In the maintenance for the ink jet head 1, the ink chamber 1*a* is controlled to have a negative pressure by which a meniscus is formed at a boundary between air and ink in each orifice 21*a* to effectively eject ink from the orifice 21. The negative pressure is generated according to a water head difference which is the height h between the tip of the ink jet head 1 and the ink surface in the ink control tank 5 and controlled to be constant. At this time, the first supply path solenoid valve 10 closes on the first air pressure supply path 9. The second supply path solenoid valve 11 opens to adjust the air layer in the ink control tank 5 to the atmospheric pressure state.

The example here uses nonaqueous oil pigment ink having physical properties such as a surface tension of 28±1 Nm/m and a viscosity of 7.5 mPa·S (@35° C.). A negative pressure capable of stable ink ejection from each orifice 21 ranges from −0.67 kPa (−5 mmHg) to −2.0 kPa (−15 mmHg). When ink to be used has other physical properties, this range differs.

For example, the following control is provided to keep the negative pressure constant. The ink control tank 5 is placed on a weight sensor (not shown). When the ink jet head 1 ejects to consume ink, a signal from the weight sensor drives the ink supply pump 4. The ink supply tank 3 supplies ink to the ink control tank 5 so as to maintain constant the level of the ink surface in the ink control tank 5. The ink supply tank 3, the ink supply pump 4, and the ink control tank 5 serve as an ink supply section.

To ensure stable ink ejection from each orifice 21 of the ink jet head 1, dirt needs to be removed from the vicinity of the orifice 21. The ink may not be ejected due to air bubbles or dirt entered the orifice 21. To prevent this from occurring, maintenance needs to be conducted.

The maintenance will be described in detail with reference to FIGS. 2 to 5.

Figure 2:
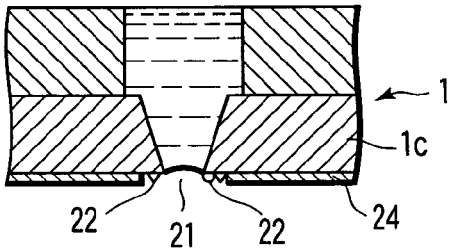
FIGS. 2 to 5 illustrate the operation in the maintenance for the ink jet printer in FIG. 1.

After printing is performed on recording paper for a specified time, particles 22 of dirt such as paper dust or air bubbles stick to the orifice 21 or its vicinity as shown in FIG. 2. To remove such particles, the first supply path solenoid valve 10 is opened, and the second supply path solenoid valve 11 is closed on the first air pressure supply path 9. Then, the pressure control section 8 is driven to apply a pressure of 10.64 kPa to the ink supply path 6 and the ink chamber 1*a* of the ink jet head 1. More specifically, the first solenoid valve 87 is opened and the second solenoid valve 88 is closed. Then, the first pressure control pump 82 applies a pressure up to 10.64 kPa in seconds without stopping.

Figure 3:
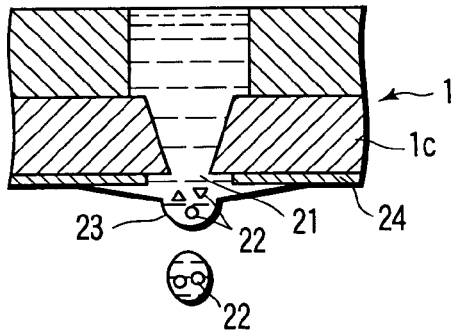

The control section 81 monitors a signal from the first pressure sensor 85. When the pressure of the second air pressure supply path 84 reaches 10.64 kPa, the first solenoid valve 87 is closed to stop the first pressure control pump 82 from operating. As shown in FIG. 3, the purge operation starts to push ink 23 from the orifice 21. At this time, the particles 22 are pushed together with the ink. This state is maintained to continue for a specified time t1. It is appropriate to set this time t1 to 10 through 15 seconds, for example. The time t1 can be extended. However, extending the time t1 consumes a large amount of ink. The discharged ink is collected as waste ink in the waste ink tray 13. After the waste ink is collected in the waste ink tray 13, the waste ink is further drawn into the first waste ink bottle 15 by means of an operation of the pump 14.

After the ink 23 is pushed from the orifice 21, the pressure of the air pressure supply path 84 may decrease as a result. In such case, the second pressure control pump 83 controls to keep the pressure of the air pressure supply path 84 at a constant 10.64 kPa.

In this manner, the purge operation is performed for the specified time t1. After this purge operation, however, there may be unremoved dirt particles or new dirt particles that were floating in the air. Such particles may remain as well as the ink unnecessarily remaining in or near the orifice 21. In this case, for example, let us assume to return respective pressures of the ink supply path 6 and the ink chamber of the ink jet head 1 to the negative pressure range of −0.67 kPa (−5 mmHg) to −2.0 kPa in order to form a meniscus at the orifice 21. The particles may be drawn as well as the remaining ink into the ink chamber from the orifice 21. If the particles are drawn, they may prevent the ink from being ejected.

Upon completion of the purge operation that pushes ink from the orifice 21, the example here maintains the pressures of the ink supply path 6 and the ink chamber 1*a* of the ink jet head 1 approximately to the atmosphere, without returning to the negative pressure for forming a meniscus. At this time, it is preferable to set the pressures for the ink chamber to a range from +0.27 kPa to −0.27 kPa and ideally to 0 kPa.

During this control operation, the needle valve 89 is controlled to connect the air pressure supply path 84 to the atmosphere without stopping, while the second solenoid valve 88 is opened and the first solenoid valve 87 is closed. At this time, the second pressure sensor 86 detects a pressure of the air pressure supply path 84. When the pressure becomes lower than −0.27 kPa, the second pressure control pump 83 operates and maintains the range between +0.27 kPa and −0.27 kPa for a specified time t2.

In this manner, the ink surface can be aligned to the surface of the orifice plate 1*c* by maintaining the pressures of the ink supply path 6 and the ink chamber 1*a* of the ink jet head 1 approximately to the atmospheric pressure. This prevents the ink chamber 1*a* from drawing particles that may hinder ink ejection.

It is desirable to set the specified time t2 to approximately 30 to 60 seconds for maintaining the pressures of the ink supply path 6 and the ink chamber 1*a* of the ink jet head 1 approximately to the atmospheric pressure. If the maximum pressure is set to +0.27 kPa, applying a positive pressure higher than this value oozes the ink from the orifice 21. If the minimum pressure is set to −0.27 kPa, applying a negative pressure lower than this value draws the ink into the orifice 21, causing a possibility of drawing particles.

Figure 4:
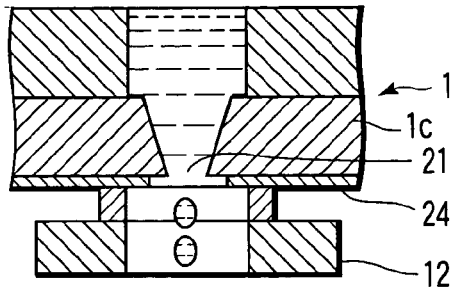

By maintaining the respective pressures of the ink supply path 6 and the ink chamber of the ink jet head 1 approximately to the atmospheric pressure, the suction nozzle 12 is set in contact with the orifice guard 24 as shown in FIG. 4. The pump 16 is then driven to use the suction nozzle 12 to suck the surface of the orifice plate 1*c*. A desirable suction flow rate is 2 to 4 liters per minute. The suction nozzle 12 sucks each of the orifices 21 while moving in the arrangement direction of the orifices 21 along the surface of the orifice plate 1*c*, that is, the orifice guard 24.

In order to protect the orifice guard 24 against damage, the same working effect can be obtained by providing a suction nozzle 12 which is separated from the orifice guard 24 by a slight air gap and performs suction during the movement.

The above-mentioned operation sucks the remaining ink which contains particles such as dirt remaining in the orifice 21 or its vicinity, and accumulates the remaining ink in the second waste ink bottle 17.

After the specified time t2 passes, the first supply path solenoid valve 10 is closed and the second supply path solenoid valve 11 is opened on the first air pressure supply path 9. This operation equalizes the air layer in the ink control tank 5 to the atmospheric pressure state.

Figure 5:
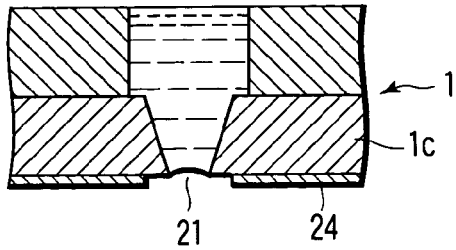

A negative pressure in the range between −0.67 kPa (−5 mmHg) and −2.0 kPa (−15 mmHg) is generated according to the water head difference h between the tip of the head 1 and the ink surface of the ink control tank 5. This causes a negative pressure state in the ink chamber of the ink jet head 1 and forms a meniscus in the orifice 21 as shown in FIG. 5.

Figure 7:
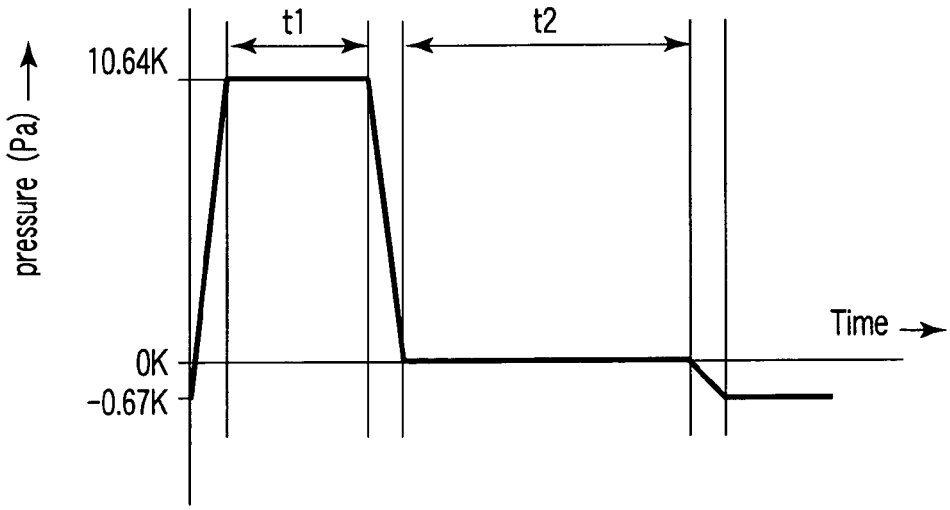
FIG. 7 is a graph showing pressure changes obtained in the maintenance operation in FIGS. 2 to 5.

Since a meniscus is formed in the orifice 21, it is possible to smoothly and stably start ejecting ink for subsequent printing without being subject to effects of particles. FIG. 7 shows changes in the pressures of the ink supply path 6 and each ink chamber for the ink jet head 1 in the maintenance operation. As shown in FIG. 7, the negative pressure state ranging from −0.67 kPa to −2.0 kPa increases to +10.64 kPa without stopping. This state continues for the specified time t1. The pressure is then decreased to the range between +0.27 kPa and −0.27 kPa approximate to the atmospheric pressure. This state continues for the specified time t2. Then, the pressure returns to the first negative pressure state ranging from −0.67 kPa to −2.0 kPa.

In the maintenance for the ink jet head, the purge operation is performed to eject ink from each orifice. Thereafter, the pressure applied to the ink surface of each orifice is maintained approximately to the atmospheric pressure. Thus, it is possible to attain a good maintenance of drawing and discarding the ink remaining at the tip of each orifice or its vicinity. Accordingly, smooth and stable ink ejection can be achieved without drawing particles such as dirt into the ink chamber from the orifice and making the ink ejection impossible.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A maintenance method for an ink jet head which ejects ink supplied from an ink control tank via an ink supply path, as ink droplets from a plurality of orifices arranged in an orifice plate, the method comprising:

controlling the pressure in said ink control tank against the atmospheric pressure applied to a surface of the ink to push the ink out of each orifice as a purging operation of ink carried out to remove particles of dirt in the ink and then maintain the pressure applied to the ink surface of each orifice approximately to the atmospheric pressure such that the surface of the ink is not set back from said orifice plate toward said ink supply path after the purging operation; and sucking ink remaining in the vicinity of each orifice and on a surface of said orifice plate surrounding each orifice in a state where the pressure applied to the ink surface of each orifice is maintained approximately to the atmospheric pressure.

2. The maintenance method according to claim 1, wherein suction of the ink is carried out in a state where the pressure applied to the ink surface is set in a range of between −0.27 kPa and +0.27 kPa.

3. The maintenance method according to claim 1, wherein the pressure in the control tank is controlled using a pressure control device that is directly connected to said ink control tank, which supplies the ink via said ink supply path to said ink jet head.

4. A maintenance apparatus for an ink jet head which ejects ink supplied from an ink control tank via an ink supply path, as ink droplets from a plurality of orifices arranged in an orifice plate, the apparatus comprising:

a pressure control section which controls the pressure in said ink control tank against the atmospheric pressure applied to a surface of the ink to push ink out of each orifice as a purging operation of ink carried out to remove particles of dirt in the ink and then maintain the pressure applied to the ink surface of each orifice approximately to the atmospheric pressure such that the surface of the ink is not set back from said orifice plate toward said ink supply path after the purging operation; and an ink suction section which sucks ink remaining in the vicinity of each orifice and on a surface of said orifice plate surrounding each orifice after the purging operation in a state where the pressure applied to the ink surface of each orifice is maintained approximately to the atmospheric pressure by said pressure control section.

5. The maintenance apparatus according to claim 4, wherein said ink suction section includes a suction nozzle which moves in an arrangement direction of said orifices along said orifice plate.

6. The maintenance apparatus according to claim 5, wherein the surface of said orifice plate is a protection member arranged to surround each orifice, and said suction nozzle is set in contact with or separated from said protection member by an air gap during the movement.

7. The maintenance apparatus according to claim 4, wherein suction of the ink is carried out in a state where the pressure applied to the ink surface is set in a range of between −0.27 kPa and +0.27 kPa.

8. The maintenance apparatus according to claim 4, wherein said pressure control section is directly connected to said ink control tank, which supplies the ink via said ink supply path to said ink jet head.

9. A maintenance apparatus for an ink jet head which ejects ink supplied via an ink supply path, as ink droplets from a plurality of orifices arranged in an orifice plate, the apparatus comprising:

a pressure control section which controls the pressure in said ink supply path against the atmospheric pressure applied to a surface of the ink to push ink out of each orifice as a purging operation of ink carried out to remove particles of dirt in the ink and then maintain the pressure applied to the ink surface of each orifice approximately to the atmospheric pressure such that the surface of the ink is not set back from said orifice plate toward said ink supply path after the purging operation; and an ink suction section which sucks ink remaining in the vicinity of each orifice and on a surface of said orifice plate surrounding each orifice after the purging operation in a state where the pressure applied to the ink surface of each orifice is maintained approximately to the atmospheric pressure by said pressure control section, wherein the pressure applied to the ink surface is set in a range of between −0.67 kPa and −2.0 kPa after suction of the ink is finished.

10. The maintenance apparatus according to claim 9, wherein suction of the ink is carried out in a state where the pressure applied to the ink surface is set in a range of between −0.27 kPa and +0.27 kPa.

11. The maintenance apparatus according to claim 9, wherein the pressure control section is directly connected to said ink control tank, which supplies the ink via said ink supply path to said ink jet head.

12. A maintenance method for an ink jet head which ejects ink supplied via an ink supply path, as ink droplets from a plurality of orifices arranged in an orifice plate, the method comprising:

controlling the pressure in said ink supply path against the atmospheric pressure applied to a surface of the ink to push the ink out of each orifice as a purging operation of ink carried out to remove particles of dirt in the ink and then maintain the pressure applied to the ink surface of each orifice approximately to the atmospheric pressure such that the surface of the ink is not set back from said orifice plate toward said ink supply path after the purging operation; and sucking ink remaining in the vicinity of each orifice and on a surface of said orifice plate surrounding each orifice in a state where the pressure applied to the ink surface of each orifice is maintained approximately to the atmospheric pressure, wherein the pressure applied to the ink surface is set in a range of between −0.67 kPa and −2.0 kPa after suction of the ink is finished.

13. The maintenance method according to claim 9, wherein suction of the ink is carried out in a state where the pressure applied to the ink surface is set in a range of between −0.27 kPa and +0.27 kPa.

14. The maintenance method according to claim 12, wherein the pressure in the control tank is controlled using a pump directly connected to said ink control tank, which supplies the ink via said ink supply path to said ink jet head.

* * * * *